US006042674A

United States Patent [19]

Todd et al.

[11] Patent Number: 6,042,674

[45] Date of Patent: Mar. 28, 2000

[54] HOSIERY BANDING APPARATUS AND METHOD

[75] Inventors: William H. Todd, Winston-Salem; Joseph L. Collins, Jr., Clemmons; Thomas A. Reavis, King; C Michael Funderburk, East Bend, all of N.C.

[73] Assignee: Todd Motion Controls, Inc., Winston Salem, N.C.

[21] Appl. No.: 09/065,133

[22] Filed: Apr. 23, 1998

[51] Int. Cl.[7] ..... B65C 5/00

[52] U.S. Cl. ..... 156/229; 156/249; 156/446; 156/447; 156/540; 156/556; 156/DIG. 19; 156/DIG. 26

[58] Field of Search ..... 156/556, 446, 156/448, 456, 542, 483, 229, 494, DIG. 19, DIG. 26, 447, DIG. 10, 249, 540

[56] References Cited

U.S. PATENT DOCUMENTS

| | | | |
|---|---|---|---|
| 2,078,448 | 4/1937 | Jost | 156/542 |
| 3,954,543 | 5/1976 | Messmer | 156/363 |
| 3,971,686 | 7/1976 | Kienel . | |
| 4,208,234 | 6/1980 | Lokey . | |
| 4,598,817 | 7/1986 | Bell, Jr. et al. | 198/468.2 |
| 4,806,197 | 2/1989 | Harvey | 156/456 X |
| 5,121,827 | 6/1992 | Ribordy . | |
| 5,188,696 | 2/1993 | Good, Jr. | 156/542 X |
| 5,259,913 | 11/1993 | Stover | 156/447 X |
| 5,290,388 | 3/1994 | Zepf | 156/447 |
| 5,478,422 | 12/1995 | Bright et al. | 156/447 X |
| 5,709,770 | 1/1998 | Asghar et al. | 156/542 X |

*Primary Examiner*—Curtis Mayes

[57] ABSTRACT

This invention is drawn to an apparatus for applying labels to hosiery, specifically sock stacks. The sock stack travels along a first conveyor and are deposited onto a second conveyor. The second conveyor carries the sock stack to a pair of rotatable clamps. The clamps hold the sock stack and stretch it. A pneumatic cylinder moves the pair of clamps upwardly into contact with an adhesive label. The socks are rotated 360 degrees drawing the label onto the sock stack to band the same.

13 Claims, 9 Drawing Sheets

HOSIERY BANDING APPARATUS AND METHOD

BACKGROUND OF THE INVENTION

1. Field of the Invention

This invention pertains to an apparatus designed to apply adhesive labels to hosiery or similar articles to thereby band the same.

2. Description of the Prior Art and Objectives of the Invention

Hosiery, such as socks, is sold in numerous packaging schemes. Sometimes the hosiery is bagged and shipped folded, loose in the bag. Other times, the hosiery is folded and then placed in adhesive labels. The labels are essentially conventional adhesively backed elongated bands which encircle the hosiery and hold it in a folded posture. Sometimes, the hosiery is banded and bagged prior to shipping.

Applying labels manually is a time consuming process wherein the folded hosiery has to be removed from a conveyor and hand rotated to apply the adhesive label to the folded hosiery. Another technique uses curved jaws which attempt to put the label around a hosiery stack, with mixed results. In the desire to improve efficiency, reduce repeated movement disorders and otherwise automate hosiery processing, it is an objective of the present invention to provide an automated apparatus which applies labels to folded hosiery such as socks.

It is a further objective of the present invention to provide an apparatus with an efficient rotatable clamp assembly.

It is still a further objective of the present invention to provide an apparatus which selectively advances a roll of labels for application to a hosiery stack.

It is yet a further objective of the present invention to provide an apparatus which properly positions and stretches hosiery prior to application of labels.

It is another objective to provide a method for automated application of labels to hosiery or articles of similar characteristics.

It is still another objective to provide an apparatus which rotates the hosiery stack 360 degrees in the process of applying labels.

Still other objects and advantages will become readily apparent to those of ordinary skill in the art upon reference to the following detailed description and figures.

SUMMARY OF THE INVENTION

This invention comprises a first conveyor which carries a hosiery stack under a band feeding assembly to a second conveyor. The second conveyor is narrower than the first and passes between a pair of spaced clamps. A selectively positionable pair of fingers acts as a stopping mechanism to hold the hosiery stack in a desired position while the spaced clamps close against and laterally stretch the hosiery stack. After stretching, the clamp assembly is elevated into close proximity to the band feeding assembly. A motor advances a strip of conventional adhesive backed labels along the band feeding assembly by turning a roller around which the label rotates. A plate, around which the strip of labels passes, forces the labels to separate from the paper backing thereby exposing an adhesive surface. As the clamp assembly is raised, the hosiery comes into contact with the exposed adhesive surface on the label. A motor then turns a rod, which in turn, rotates each clamp simultaneously 360 degrees. The adhesive sticks to the hosiery and draws the label off the backing and onto the hosiery stack as it is rotated. Proper alignment of the band feed assembly assures that the label closes upon itself and creates an appropriate band around the hosiery stack.

A number of sensors selectively advance the strip of labels while monitoring the application of labels to the hosiery stacks. After successful application of a label to a particular hosiery stack, the clamp assembly is lowered and releases the socks to continue on the second conveyor for further processing. Conventional pneumatic cylinders and electric motors provide motive force to the various parts of the apparatus.

DETAILED DESCRIPTION OF THE PREFERRED EMBODIMENT AND OPERATION OF THE INVENTION

Figure 1:
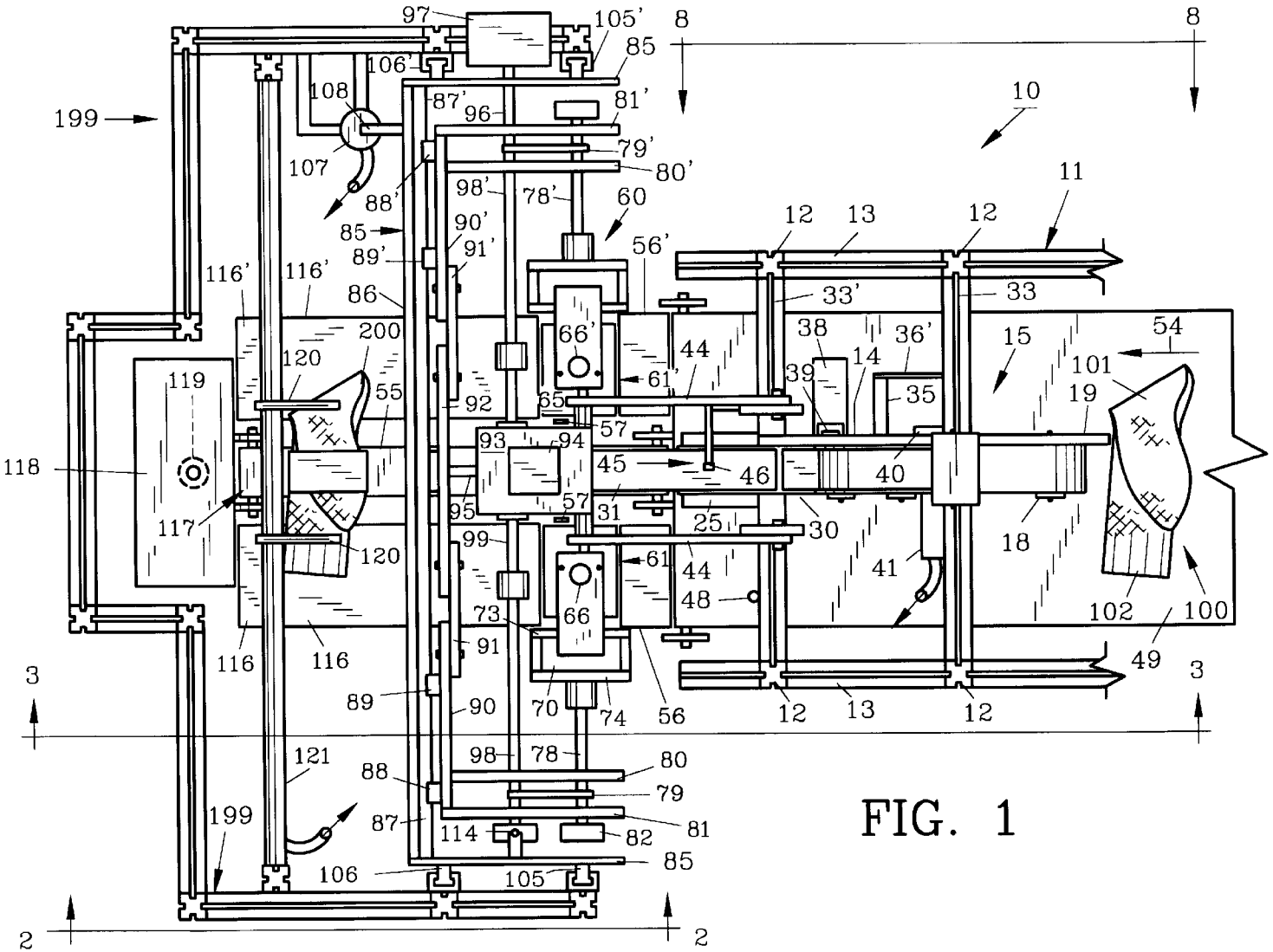
FIG. 1 shows a top schematic view of the apparatus of the present invention.
Figure 2:
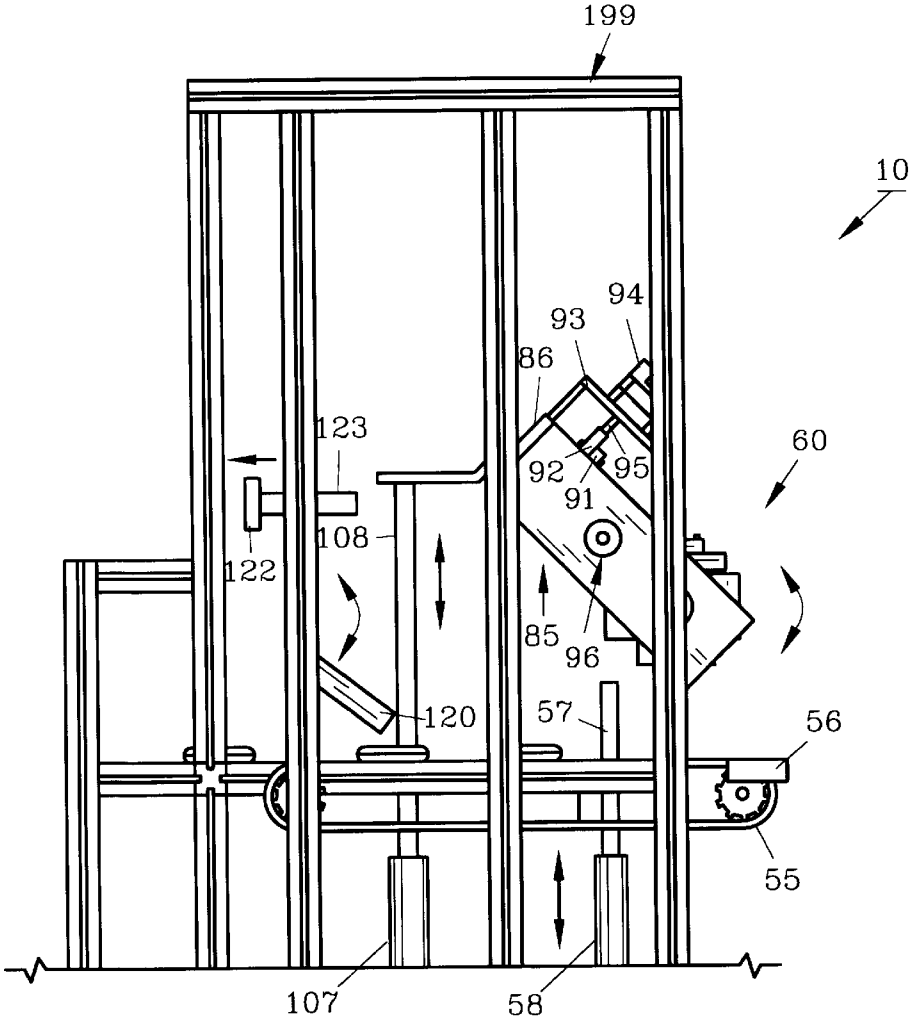
FIG. 2 illustrates a side schematic view of the apparatus along lines 2—2 of FIG. 1.
Figure 3:
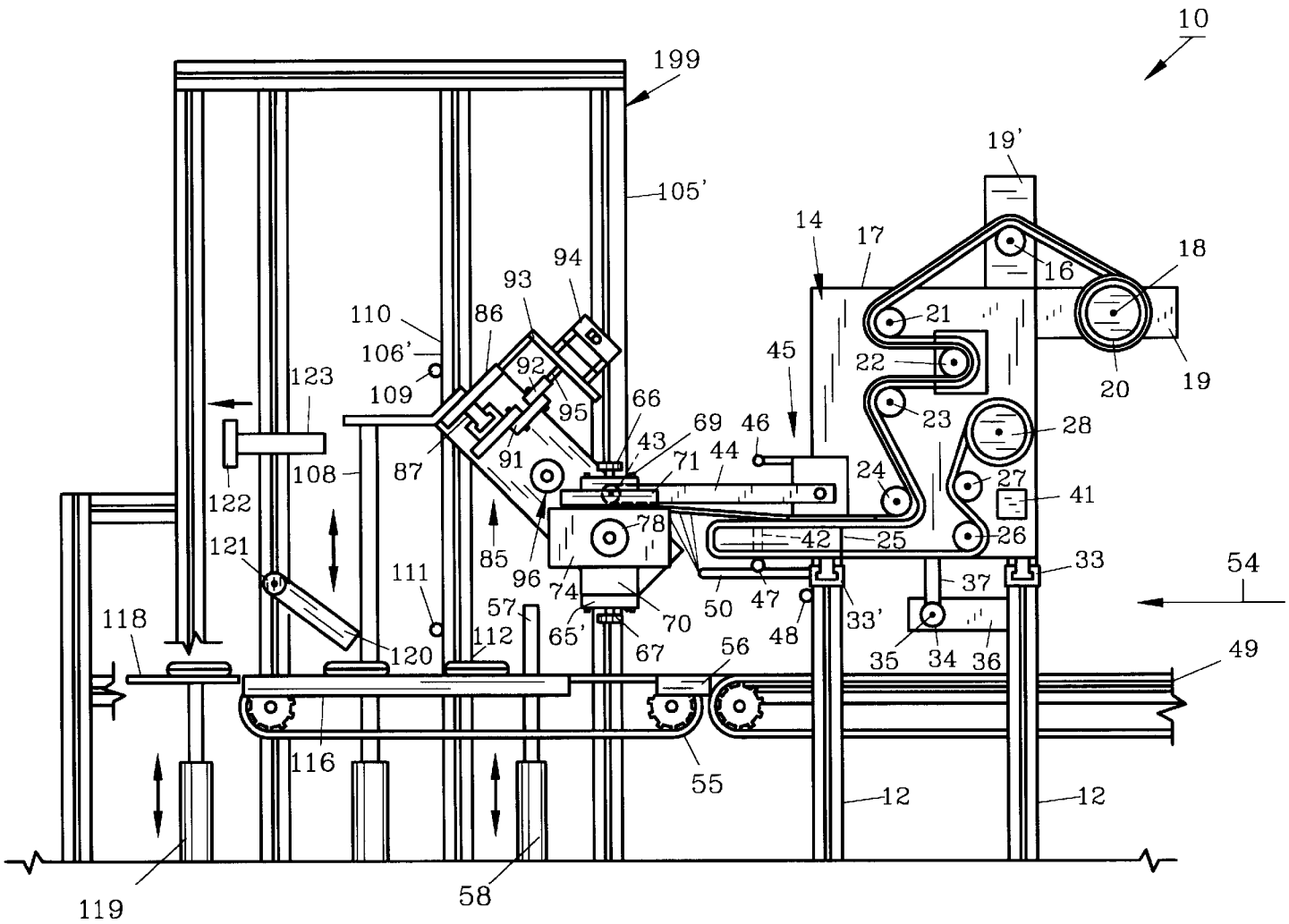
FIG. 3 demonstrates another side schematic view of the apparatus along lines 3—3 of FIG. 1.
Figure 8:
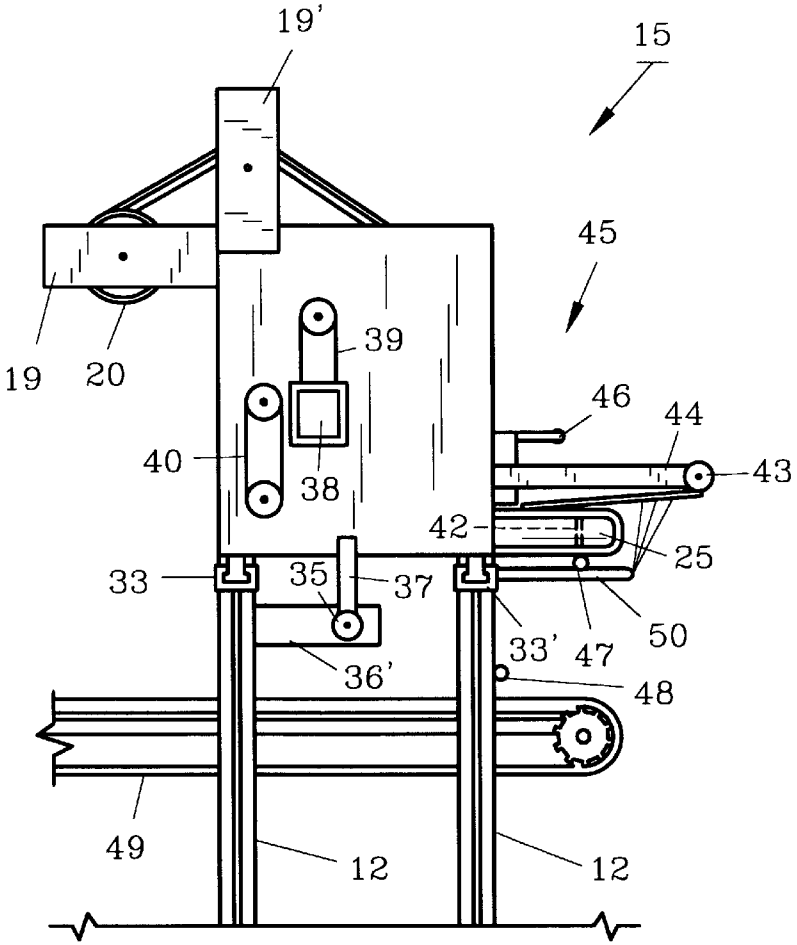
FIG. 8 represents a back view of the band feeding assembly of the present invention, as seen along lines 8-8 of FIG. 1.

Turning now to the figures, specifically FIG. 1 shows a top view of preferred banding apparatus 10 while FIGS. 2, 3 and 8 show side views taken from FIG. 1. Frame 11 comprises vertical members 12 and horizontal members 13 which support steel planar back 14.

Band feeding assembly 15, as seen better in FIGS. 2, 3 and 8, comprises first roller 16 (FIG. 3) near top edge 17 of steel back 14. Alternate first roller 18 is also positioned near top edge 17 of steel back 14, but is mounted on horizontal support bar 19 as opposed to vertical support bar 19' which supports first roller 16. In use, roll 20 (see also FIG. 7) is a sixteen inch (40.6 cm) diameter roll of labels mounted on alternate first roller 18, and the loose end of the roll (not shown) is fed over first roller 16, angularly downward to second roller 21, around third roller 22, around fourth roller 23, down to fifth roller 24, around feed plate 25 to sixth roller 26, up to seventh roller 27 and finally to winding roller 28. Alternately, a smaller diametered roll (not shown) can be mounted on first roller 16 and around the rest of the rollers as described to winding roller 28. This alternate positioning allows differently sized rolls to be used with banding apparatus 10, since large rolls, such as roll 20, if positioned on first roller 16, would interfere with the positioning of third roller 22. Steel back 14 is laterally adjustable on tracks 33, 33' by manipulating knob 34 which is attached to threaded member 35. Support plates 36, 36' are horizontally positioned to support knob 34 and threaded member 35. This assembly moves vertically positioned plate 37, which is also attached to back 14. As plate 37 moves along threaded member 35, it laterally propels back 14 along tracks 33, 33'.

Figure 7:
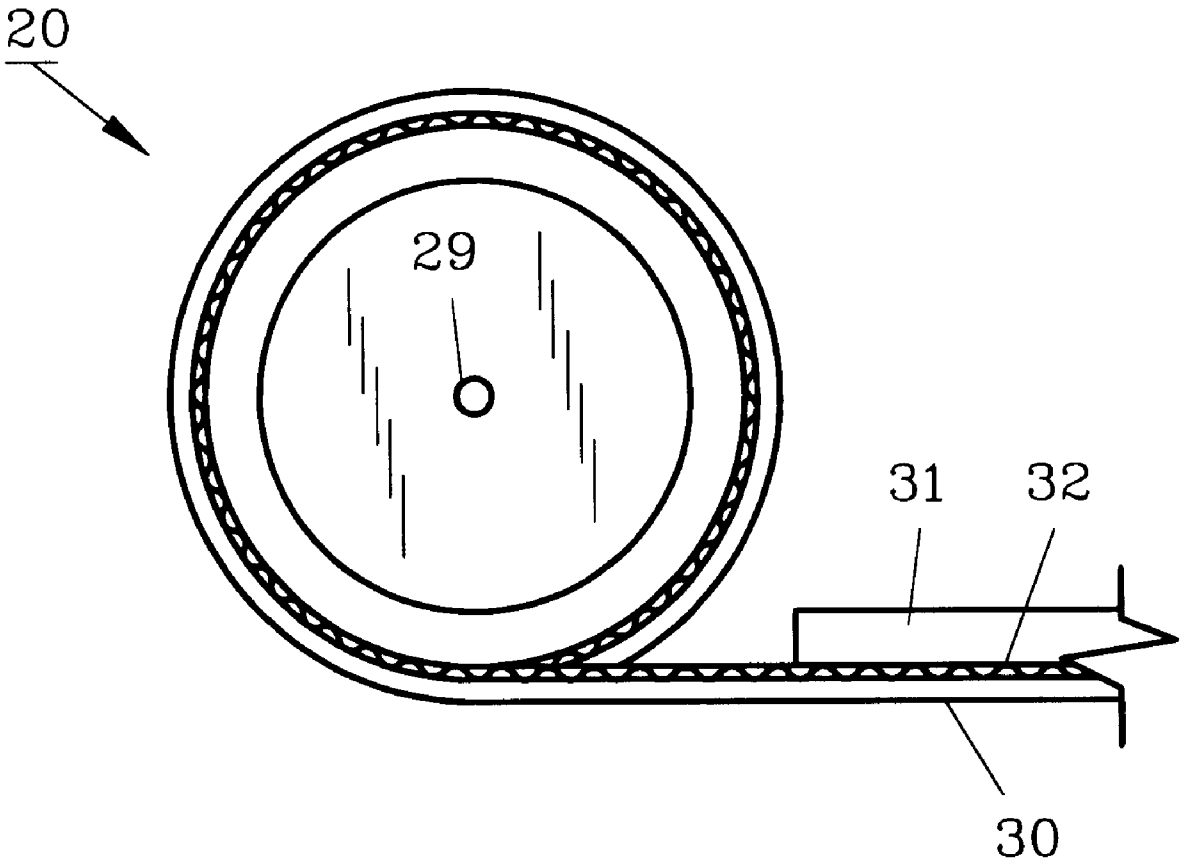
FIG. 7 shows a label roll removed from the banding apparatus.

Label rolls, such as roll 20, seen in FIG. 7, comprise inner annular core 29, which is conventionally attached to backing 30. Backing 30 is preferably wax paper or other conventional "non-stick" flexible material to which bands or labels 31 are attached by adhesive ply 32. This three ply assembly is wound around core 29. Labels 31 peel off backing 30 easily and are conventional, as is roll 20.

As seen in FIGS. 1 and 8, band feeding assembly 15 includes stepper motor 38 which powers third roller 22 by means of first timing belt 39. Additionally, second timing belt 40 connects winding roller 28 to rotating pneumatic driver 41 (FIGS. 1 and 3). This driver keeps the loose end of backing 30 taunt on winding roller 28 by applying rotational pressure to winding roller 28.

Winding roller 28 is preferably a cylindrically shaped rod with a pair of grooves (not shown). A U-shaped member (also not shown) slides into these grooves to sandwich and trap the loose end of backing between the U-shaped member and the cylinder. The U-shaped member is preferably held in place by a threaded member or the like (not shown).

In FIGS. 1 and 3, feed plate 25 is proximate rolling weight 43. Proximate rolling weight support bar 44 is sensor 45. Sensor 45 preferably comprises transmitting unit 46 and receiving unit 47 spaced from one another. Transmitting unit 46 sends a weak electromagnetic signal towards receiving unit 47 by passing through channel 42, which is defined by plate 25. The signal only has the strength to pass through backing 30. Thus, if a label, such as label 31, is still adhered to backing 30, the composite is dense enough to block the signal. Sensor 48 is a sock sensor, and senses whether socks have passed therebeneath on first conveyor 49. Air nozzle 50 is positioned below feed plate 25. While not shown in FIGS. 1 and 3, potentiometer 333 is also positioned at the pivot point of rolling weight support bar 44. Sensors 45 and 48 may be repositioned as needed and additional guide elements may be incorporated such as a guide plate (not shown) which covers labels 31 and backing 30 as it passes over feed plate 25.

Frame 11 and back 14 support band feeding assembly 15 above first conveyor 49. First conveyor 49 is conventional and supported on a frame by horizontal and vertical members (not shown). First conveyor 49 carries hosiery such as unbanded sock stack 100 longitudinally, as indicated by arrow 54 to second conveyor 55. Second conveyor 55 is substantially narrower than first conveyor 49 and also narrower than sock stack 100 so ends 101 and 102 of sock stack 100 are not supported by second conveyor 55.

Proximate first conveyor 49, second conveyor 55 is surrounded by support plates 56, 56' (FIGS. 1–3). Sock stack 100 is carried by second conveyor 55 into rotatable clamp assembly 60. Selectively raisable fingers 57 prevent sock stack 100 from passing through rotatable clamp assembly 60 (seen raised in FIG. 2). Fingers 57 are selectively raisable by pneumatic cylinder 199 which is mounted on frame 58 of banding apparatus 10. Frame 199 supports the majority of the components aside from band feeding assembly 15 and first conveyor 49.

Figure 4:
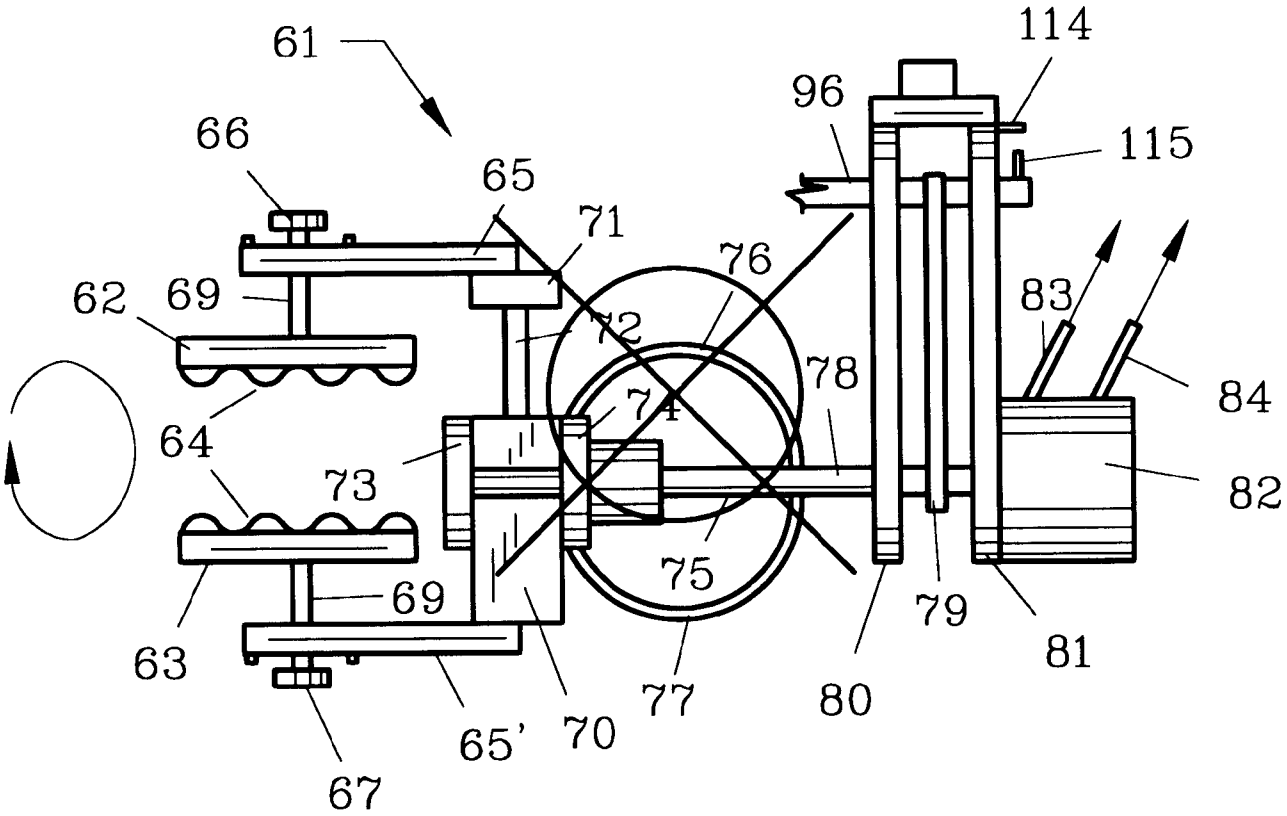
FIG. 4 features a close-up view of the clamp mechanism as removed from the banding apparatus.

Clamp 61 is seen removed from banding apparatus 10 in FIG. 4. Clamp 61 is substantially identical in structure and operation to clamp 61', one being the mirror image of the other. Clamp 61 comprises upper jaw 62 and lower jaw 63. Both upper and lower jaws 62 and 63 include frictional surface 64, which may be rubber or the like. Jaws 62 and 63 are adjustably positionable relative to horizontal plates 65 and 65' respectively by threaded adjusting members 66 and 67. Additional guide rods 69 prevent jaws 62 and 63 from rotating as adjusting members 66 and 67 are turned to the proper extensions. Horizontal plate 65' is attached to the bottom of pneumatic cylinder 70, while horizontal plate 65 is attached to terminal end 71 of rod 72 which is controlled by pneumatic cylinder 70. Thus, pneumatic cylinder 70 raises and lowers upper jaw 62 to open and close clamp 61. Pneumatic cylinder 70 is sandwiched between vertical plates 73 and 74. Vertical plates 73, 74 are in turn connected by rods 75 (only one shown). Vertical plate 74 receives air lines 76, 77 and is turned by rod 78. When plate 74 is turned, clamp 61 is rotated as generally indicated by the arrow left of clamp 61. Rod 78 is turned by timing belt 79, which is positioned between diagonally depending supports 80, 81. Rod 78 fluidly communicates through supports 80 and 81 to pneumatic intake 82, which in turn receives pneumatic lines 83 and 84. Pneumatic intake 82 is fixed relative to supports 80 and 81. Sensor 114 is positioned proximate clamp 61 and detects the presence of post 115. Thus, sensor 114 indicates when clamp 61 is vertically positioned so that clamp assembly 60 may be lowered.

Figure 6:
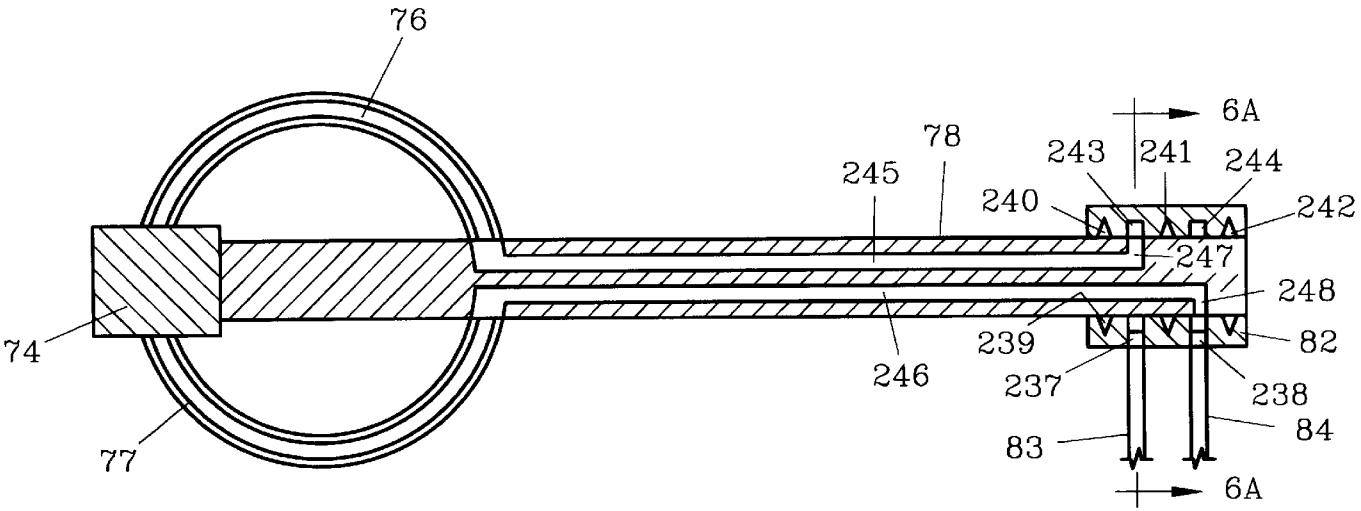
FIG. 6 depicts an enlarged cross-sectional view of the rotatable pneumatic feed for the clamp.
Figure 6A:
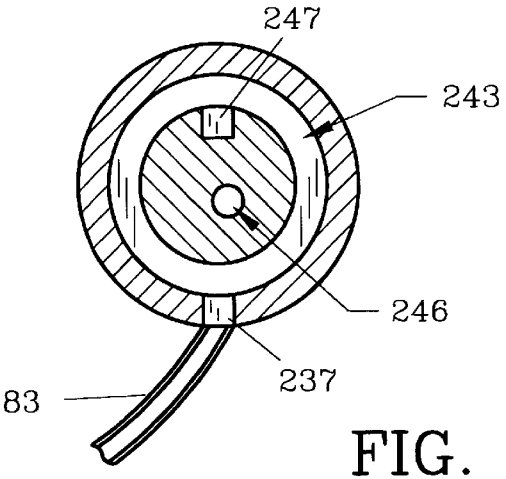
FIG. 6A illustrates a lateral cross-sectional view of FIG. 6 along lines 6A—6A.

An enlarged cross-sectional view of rod 78 and intake 82 is seen in FIGS. 6 and 6A, which discloses that both are preferably steel. Intake 82 is preferably a cylindrical annulus which defines five grooves 240–244 on interior surface 239. Grooves 240–244 completely surround rod 78. Conventional o-rings fill grooves 240–242 and isolate groove 243 from groove 244. Air from pneumatic lines 83 and 84 enters intake 82 and proceeds through channels 237 and 238 respectively to fluidly communicate with grooves 243 and 244 respectively. Air channels 245 and 246 fluidly communicate with grooves 243 and 244 respectively. Thus l-shaped proximal ends 247 and 248 rotate as rod 78 turns and are in continuous fluid communication with grooves 243 and 244 respectively. FIG. 6A provides an alternate view of this arrangement for groove 243. This arrangement allows air to pass from a compressor (not shown) through lines 83 and 84 into rod 78 and to plate 74 where it is then fed into pneumatic cylinder 70 to open and close clamp 61.

Returning to FIGS. 1–3, clamps 61 and 61' are positioned on rotatable clamp assembly 60. Rotatable clamp assembly 60 comprises generally U-shaped member 85 (FIG. 1). Top bar 86 includes tracks 87, 87' which support runners 88, 89 and 88', 89', which hold members 90, 90' on tracks 87, 87' respectively. Members 90, 90' are perpendicular to and rigidly attached to diagonally depending supports 80, 81 and 80', 81' respectively. Members 90, 90' are in turn pivotally affixed to connectors 91, 91' respectively, which are in turn pivotally connected to cross member 92 on opposite ends thereof. Proximate cross member 92 and superiorly positioned of the same is pneumatic support member 93 which maintains pneumatic cylinder 94 and is rigidly attached to top bar 86. Cylinder 94 is connected by rod 95 to cross member 92 for moving the same. When rod 95 is extended, cross member 92 is in linear alignment with connectors 91, 91', and members 90, 90'. When rod 95 is retracted by cylinder 94, cross member 92 is parallel to, but not aligned with members 90, 90'. Connectors 91, 91' pivot relative to cross member 92 and members 90, 90' so as to form a generally y-shaped structure. This movement of cross member 92 causes members 90, 90' to move laterally on tracks 87, 87', thereby increasing or decreasing the distance between clamp 61 and clamp 61'. Timing belts 79, 79' are controlled by rod 96 which extends to motor 97. Rod 96 comprises a series of telescoping members 98, 98' and 99 which telescope in accordance with the movement of members 90, 90' on tracks 87, 87'. When motor 97 rotates rod 96, both timing belts 79, 79' are turned simultaneously, thereby rotating clamps 61, 61', also simultaneously.

Clamp assembly 60 is raised and lowered on tracks 105, 106 and 105', 106' by pneumatic cylinder 107 and rod 108 (FIGS. 2 and 3). Sensor 109 is positioned near top end 110 of track 106' and signals the microprocessor that clamp assembly 60 is raised, if in fact assembly 60 is raised. Likewise, sensor 111 is positioned near bottom end 112 of track 106' and signals the microprocessor that clamp assembly 60 is lowered, if in fact assembly 60 is lowered. A rubber bushing (not shown) is preferably used to stop upward movement of clamp assembly 60. Tracks 87, 87' are positioned on frame 199, as is second conveyor 55.

Plates 116, 116' are attached to frame 199 and are positioned on either side of distal end 117 of second conveyor 55 to support sock ends 101 and 102. Proximate distal end 117 of second conveyor 55 is lift plate 118 controlled by pneumatic cylinder 119. Sweep fingers 120 are rotatably positioned above second conveyor 55 and are controlled by rotatable pneumatic cylinder 121. In use, banded sock stack 200 travels down second conveyor 55 after being banded and are "swept" onto lift plate 118 by sweep fingers 120. Lift plate 118 lifts sock stack 200 upwardly. Pushing plate 122, controlled by pneumatic cylinder 123, pushes sock stack 200 onto a third conveyor (not shown) for further processing. Such components are attached to frame 199 by conventional support members not specifically labeled, and not necessarily shown, but affixed to frame 199.

The preferred method of using banding apparatus 10 comprises allowing hosiery such as folded sock stack 100 to travel longitudinally along first conveyor 49 as indicated by arrow 54. When first conveyor ends, sensor 48 detects sock stack 100 and alerts a microprocessor to start the banding cycle. Sock stack 100 is passed to second conveyor 55 and support plates 56, 56', and in due course to first and second clamps 61 and 61' respectively, which are initially open. Fingers 57 are raised by pneumatic cylinder 199 and stop sock stack 100 in the desired position between jaws 62, 63 and 62', 63'. Pneumatic cylinders 70, 70' close first and second clamps 61 and 61' respectively, thereby grasping sock stack 100 therebetween. Pneumatic cylinder 94 then extends rod 95, which lowers cross member 92, thereby forcing connectors 91, 91' to pivot relative to cross member 92 and members 90, 90'. Members 90, 90' slide laterally, outwardly on tracks 87, 87' as all five members 90, 90', 91, 91' and 92 are brought into a linear arrangement. This movement causes diagonally depending members 80, 81 and 80', 81' to move apart in a lateral direction, thereby spreading clamps 61, 61' and stretching sock stack 100 therebetween.

After stretching sock stack 100, pneumatic cylinder 107 activates, thereby extending rod 108 and pushing upwardly on U-shaped member 85 and raising entire clamp assembly 60 on tracks 105, 106, 105' and 106'. Sensor 109 signals the microprocessor that clamp assembly 60 is in fact raised. Meanwhile, stepper motor 38 of band feeding assembly 15 has turned third roller 22, and pneumatic driver 41 has turned winding roller 28 to advance roll 20 along band feeding assembly 10. Sensor 45 signals the microprocessor to advance roll 20 in order to partially peel off a label, such as label 31, from backing 30 by advancing backing 30 around feed plate 25. The sharp edge of feed plate 25 causes peeling to occur. Thus one end of label 31 will hang freely over clamp assembly 60.

Air nozzle 50 activates, directing a stream of air at the lower surface of the depending part of label 31, forcing it into a nearly horizontal position over clamp assembly 60. Since label 31 now extends outwardly above clamp assembly 60, when clamp assembly 60 is raised, the middle of sock stack 100 contacts adhesive ply 32 on label 31. This allows label 31 to stick or adhere to sock stack 100. After such contact, motor 97 operates to turn rod 96, simultaneously timing belts 79, 79' turn clamp rods 78, 78'. As clamp rods 78, 78' rotate, so do clamps 61, 61'. Preferably, clamps 61, 61' are rotated a full 360 degrees, wrapping label 31 completely around sock stack 100. Sensor 114 detects the presence of post 115 thereby alerting the microprocessor when a full rotation has been accomplished. Since clamps 61, 61' must be vertically positioned in order to receive sock stack 100 at the beginning of the cycle, sensor 114 helps insure that clamps 61, 61'do not overly rotate.

Clamp assembly 60 is then lowered on tracks 105, 106, 105', and 106' to its original position. Sensor 111 tells the microprocessor that clamp assembly 60 has in fact been lowered. Fingers 57 are lowered, and clamps 61, 61' open. Banded sock stack 200 then is moved by second conveyor 55 and support plates 116, 116' to distal end 117 of second conveyor 55. Sweep fingers 120 are rotated so as to sweep banded sock stack 200 onto lift plate 118. Lift plate 118 is in turn lifted to a position proximate the third conveyor (not shown) where pushing plate 122 urges banded sock stack 200 onto the third conveyor for further processing such as the insertion of a j-hook, bagging or other usual processing.

Figure 5:
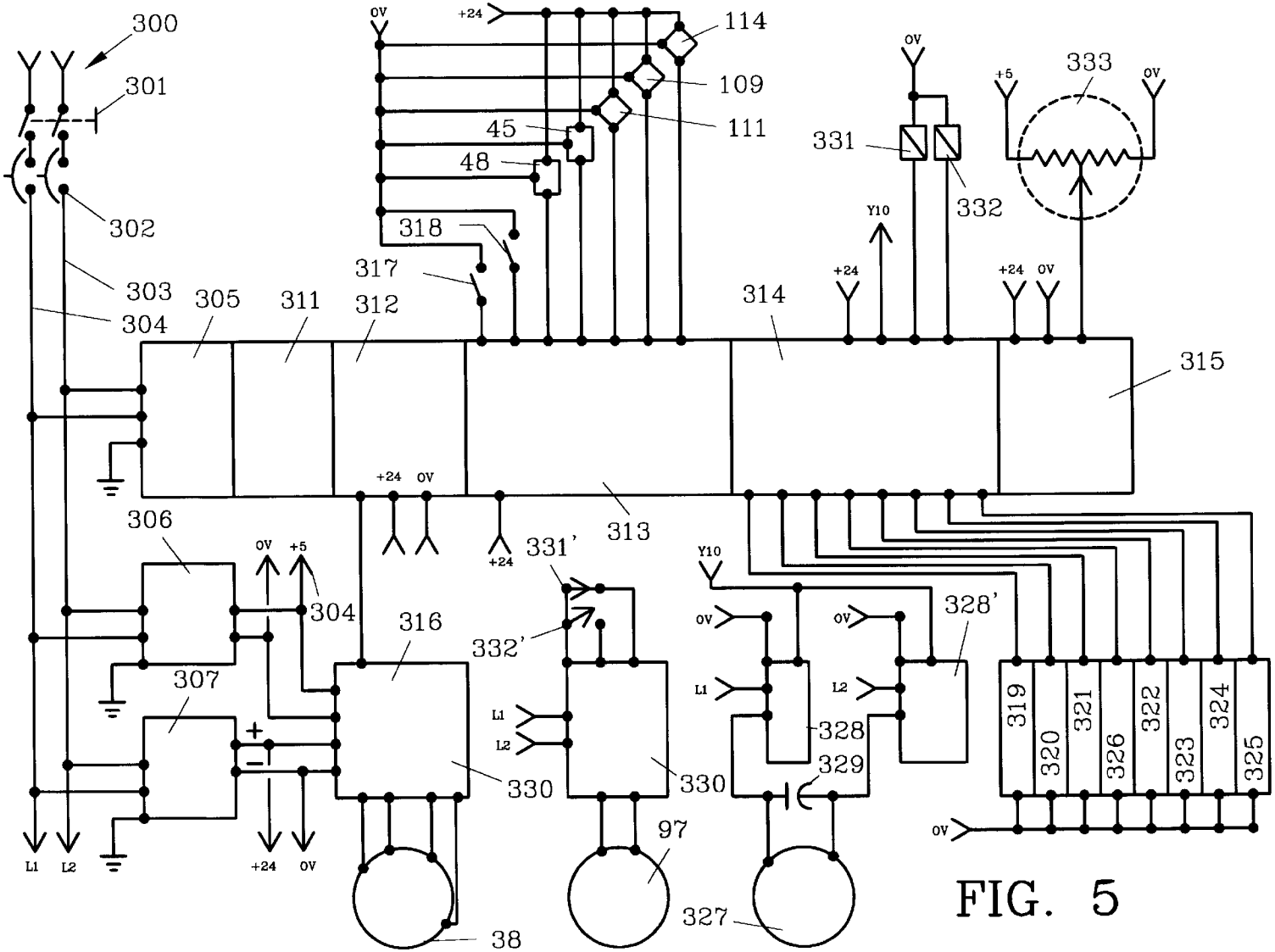
FIG. 5 pictures an electrical schematic for the electrical circuitry used on the banding apparatus of FIG. 1.

As noted, the above process is controlled by a microprocessor and accompanying electrical circuitry, which is schematically disclosed in FIG. 5. Conventional 220 V AC power comes in at feed 300 and passes through manual disconnect 301 to conventional 10 amp 2-pole circuit breaker 302. High voltage line 303 and neutral line 304 connect to CPU power supply 305, 5 V power supply 306, 24 V power supply 307 and provides connections where indicated at L1 and L2. 5 V power supply 306 is a conventional power supply which converts AC voltage to DC voltage at 5 V and provides connections where indicated throughout the schematic of FIG. 5 by a 5 V marking. Power supply 307 converts AC voltage to DC voltage at 24 V and provides the 24 V connections indicated throughout the schematic. Proximate CPU power supply 305, and electrically connected thereto is CPU module 311, pulse output module 312, sinking input module 313, sourcing output module 314 and analog input module 315.

CPU module 311 contains the microprocessor discussed above and supporting circuitry to provide the control for banding apparatus 10 while pulse output module 312 provides selective input to stepper driver 316, which in turn controls stepper motor 38. Stepper driver 316 also receives power inputs from 5 V power supply 306 and 24 V power supply 307. Note that pulse output module 312 also receives 24 V as indicated.

Sinking input module 313 receives input from the various sensors and switches thereby alerting the microprocessor of the status of banding apparatus 10. Specifically, sinking input module 313 receives a 24 V for power and controls sensor 114 (clamp orientation sensor); sensor 109 (clamp assembly up sensor); sensor 111 (clamp assembly down sensor); sensor 45 (roll advance to feed label sensor); and sensor 48 (sock detection sensor). Additionally, enable switch 317 and setup switch 318 provide additional control over banding apparatus 10. Specifically, enable switch 317 is essentially a by-pass switch for banding apparatus 10. Thus, if banding apparatus 10 is part of a larger sock processing apparatus (e.g. a full assembly line), and the user does not wish to band a particular run of socks, switch 317 allows sock stack 100 to pass through banding apparatus 10 without manipulation by clamp assembly 60. Set-up switch 318 manually raises clamp assembly 60 for adjusting purposes, such as when differently sized socks are being used on banding apparatus 10, and there is a need to adjust the spacing between jaws 62, 63 and 62', 63' by adjusting members 66 and 67 (FIG. 4).

Sourcing output module 314 controls solenoids 319–326 which in turn operate pneumatic valves 250–257 respectively. Sourcing output module 314 also controls AC motor 327 by means of solid state relays 328, 328' and capacitor 329. While not connected on the drawings, points Y10 are electrically connected to provide this control. Note that solid state relay 328 receives input from line 304 and relay 328' receives input from line 303. AC motor 327 controls second conveyor 55. Finally sourcing output module 314 controls DC driver 330 by means of relay coils 331 and 332 which connect to relays 331' and 332' respectively. Relay 331' is normally closed, and relay 332' is normally open. If relay 331' is closed DC driver 330 is enabled and DC motor 97 operates to rotate clamps 61, 61'. When relay 332' is closed a second speed is enabled, thus allowing selective multi-speed rotation of clamps 61, 61'.

Analog input module 315 receives input from potentiometer 333 and instructs the microprocessor how large a bundle of socks, such as sock stack 100 is being processed. Potentiometer 333 is located at the pivot point of rolling weight support bar 44.

Figure 9:
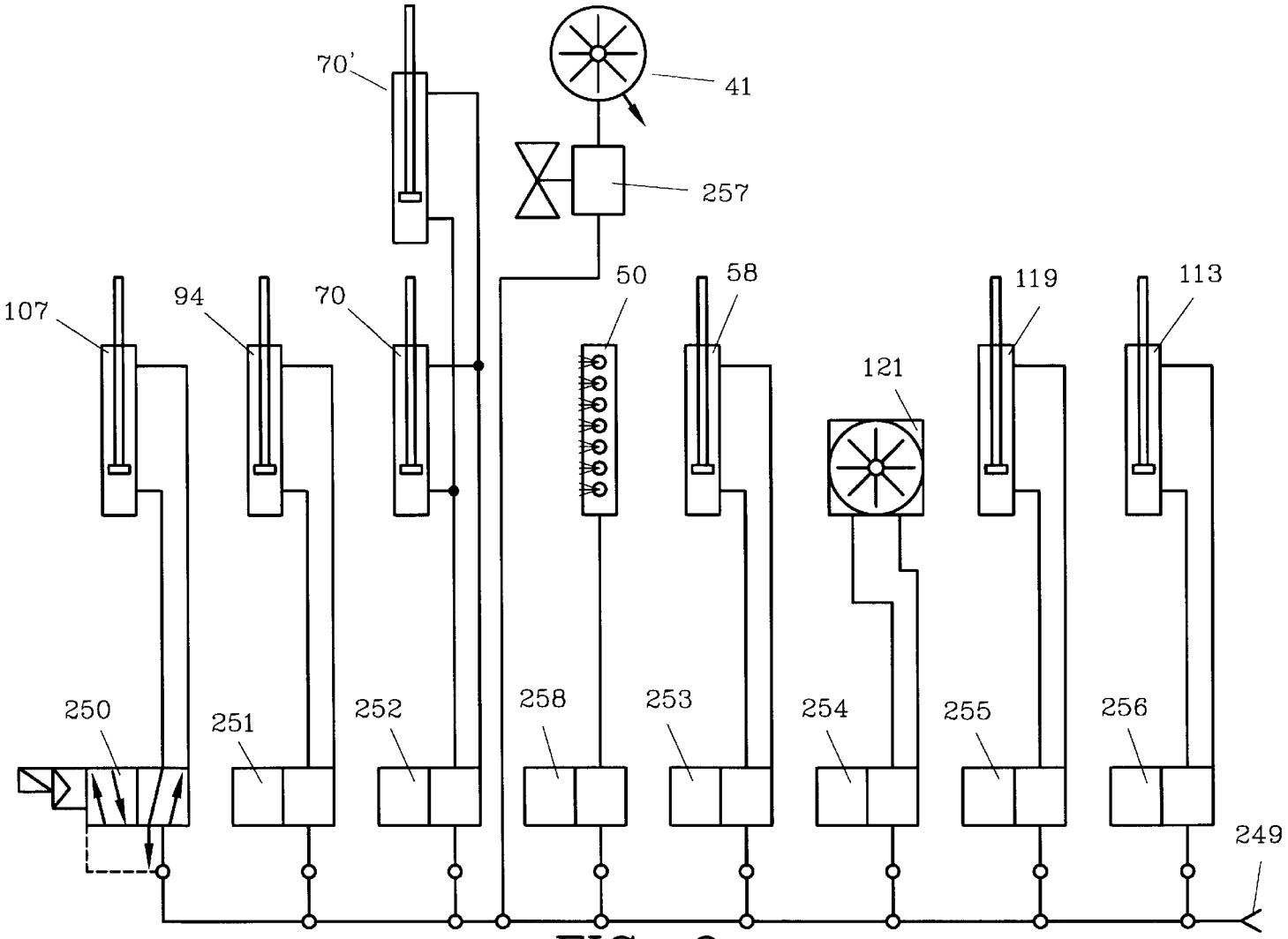
FIG. 9 illustrates a schematic view of the pneumatics used in the banding apparatus of FIG. 1.

The pneumatics of the present invention are revealed in FIG. 9 and consist of a series of parallel pneumatic circuits with conventional pneumatic valves all fed by 80 PSI pneumatic feed 249. Valve 250 controls pneumatic cylinder 107, which lifts rotatable clamp assembly 60. Pneumatic valve 251 controls pneumatic cylinder 94, which pushes cross member 92 and stretches sock stack 100 in clamps 61, 61'. Valve 252 controls pneumatic cylinders 70, 70' which open and close clamps 61, 61' respectively. Valve 253 controls pneumatic cylinder 199, which raises and lowers fingers 57. Valve 254 controls rotatable pneumatic cylinder 121, which sweeps banded sock stack 200 onto lift plate 118. Valve 255 controls pneumatic cylinder 119, which raises lift plate 118 to the third conveyor (not seen). Valve 256 controls pneumatic cylinder 123 which pushes banded sock stack 200 onto the third conveyor. Additionally valve 257 controls air motor 41 which selectively advances winding roll 28. Valve 258 controls air nozzle 50 which elevates label 31 prior to application to sock stack 100.

The preceding recitation is provided as an example of the preferred embodiments and is not intended to limit the nature of scope of the present invention or the appended claims. Although hosiery is used in the examples provided, other articles could likewise be banded by the apparatus and methods as herein described with adjustements made for particular sized and shaped articles by those skilled in the art.

We claim:

1. A method of banding an article, said method comprising the steps of:

a) clamping an article in a rotatable clamp assembly;

b) positioning the clamped article proximate a band feed assembly;

c) rotating the clamped article;

d) stretching the article; and e) applying an adhesive label to the article.

2. The method of claim 1 wherein applying an adhesive label to the article comprises the step of selectively advancing a label from the band feed assembly.

3. The method of claim 2 wherein selectively advancing a label from the band feed assembly comprises the step of moving a backing strip around a plate.

4. The method of claim 1 further comprising the step of positioning the article proximate the rotatable clamp assembly prior to clamping the article.

5. The method of claim 4 wherein positioning the article proximate the rotatable clamp assembly comprises the step of moving the article by a conveyor.

6. The method of claim 5 wherein positioning the article proximate the rotatable clamp assembly further comprises the step of stopping the article.

7. The method of claim 1 wherein positioning the clamped article proximate a band feed assembly comprises the step of raising the clamp assembly.

8. Apparatus for banding an article, said apparatus comprising:

a) a rotatable clamp assembly, said rotatable clamp assembly comprising a pair of horizontally spaced clamps;

b) a band feed assembly, said band feed assembly proximate said rotatable clamp assembly; and c) a label, said label positioned on said band feed assembly, whereby said label is selectively advanced to engage the article.

9. The apparatus of claim 8 wherein said horizontally spaced clamps of said rotatable clamp assembly are spatially aligned.

10. The apparatus of claim 9 further comprising a first conveyor, said first conveyor positioned between said pair of clamps.

11. The apparatus of claim 8 wherein said rotatable clamp assembly raises the article to contact said label.

12. The apparatus of claim 8 wherein said band feed assembly comprises:

i) a first spool;

ii) a second spool, said second spool proximate said first spool; and iii) a plate, said plate positioned between said first and second spools.

13. The apparatus of claim 12 wherein said label comprises a backing, an adhesive ply and at least one sticker, said sticker positioned on said backing and held thereon by said adhesive, said backing wound on said first spool and selectively advanced around said second spool.

* * * * *